US010076171B2

(12) United States Patent
Spann Myers

(10) Patent No.: US 10,076,171 B2
(45) Date of Patent: Sep. 18, 2018

(54) TWO WAY PLASTIC NEEDLE

(71) Applicant: Josephine Spann Myers, Orange Park, FL (US)

(72) Inventor: Josephine Spann Myers, Orange Park, FL (US)

( * ) Notice: Subject to any disclaimer, the term of this patent is extended or adjusted under 35 U.S.C. 154(b) by 90 days.

(21) Appl. No.: 15/244,253

(22) Filed: Aug. 23, 2016

(65) Prior Publication Data

US 2018/0055185 A1 Mar. 1, 2018

(51) Int. Cl.
*A45D 8/34* (2006.01)
*A45D 7/00* (2006.01)

(52) U.S. Cl.
CPC ..... *A45D 8/34* (2013.01); *A45D 2007/004* (2013.01)

(58) Field of Classification Search
CPC ..... A45D 2002/008; A45D 2007/004; A45D 8/02; A45D 8/04; A45D 8/34
USPC ..... 131/201
See application file for complete search history.

(56) References Cited

U.S. PATENT DOCUMENTS 3,678,712 A * 7/1972 Singleton ..... D04B 3/00 223/102
4,307,908 A * 12/1981 Donaldson ..... A45D 2/00 132/200
5,211,710 A * 5/1993 Nagano ..... D04B 31/02 66/1 A

FOREIGN PATENT DOCUMENTS

JP 05171546 A * 9/1993
WO WO-9201107 A * 1/1992

OTHER PUBLICATIONS

Magic Topsy Tail Hair Braid Ponytail Styling Maker CLip Tool; website; https://www.amazon.ca/dp/B00UZWYV4Y/ref=sspa_dk_detail_2?psc=1, accessed on Mar. 5, 2018; published Mar. 21, 2015.*

Breanna Rutter; Crotchet Braids Step by Step Tutorial How to Latch Hook Hair Weave Techynique & Tips Part 3; YouTube.com video; https://www.youtube.com/watch?v=2MAe0gKrU5c; accessed on Mar. 5, 2018; published May 7, 2013.*

* cited by examiner

*Primary Examiner* — Daniel James Colilla

(57) ABSTRACT

The present innovation of the Two Way Plastic Needle identifies with another technique for crocheting, weaving and sewing the hair. The Two Way Plastic Needle is in an oblong flexible adaptable shape at the highest point of the needle, for crocheting in dreadlock hair augmentations, Interlock hair expansions, hair meshes, hair turn, utilizing characteristic sew hair or engineered hair. The Two Way Plastic Needle identifies with the pointed end of the little opening of the needle, to thread the needle and go underneath the braid twist to add-on and sew in the weft of the hair augmentation to the braid twist of the hair for furnishing a client with presence of having longer, fuller thicker hair.

1 Claim, 1 Drawing Sheet

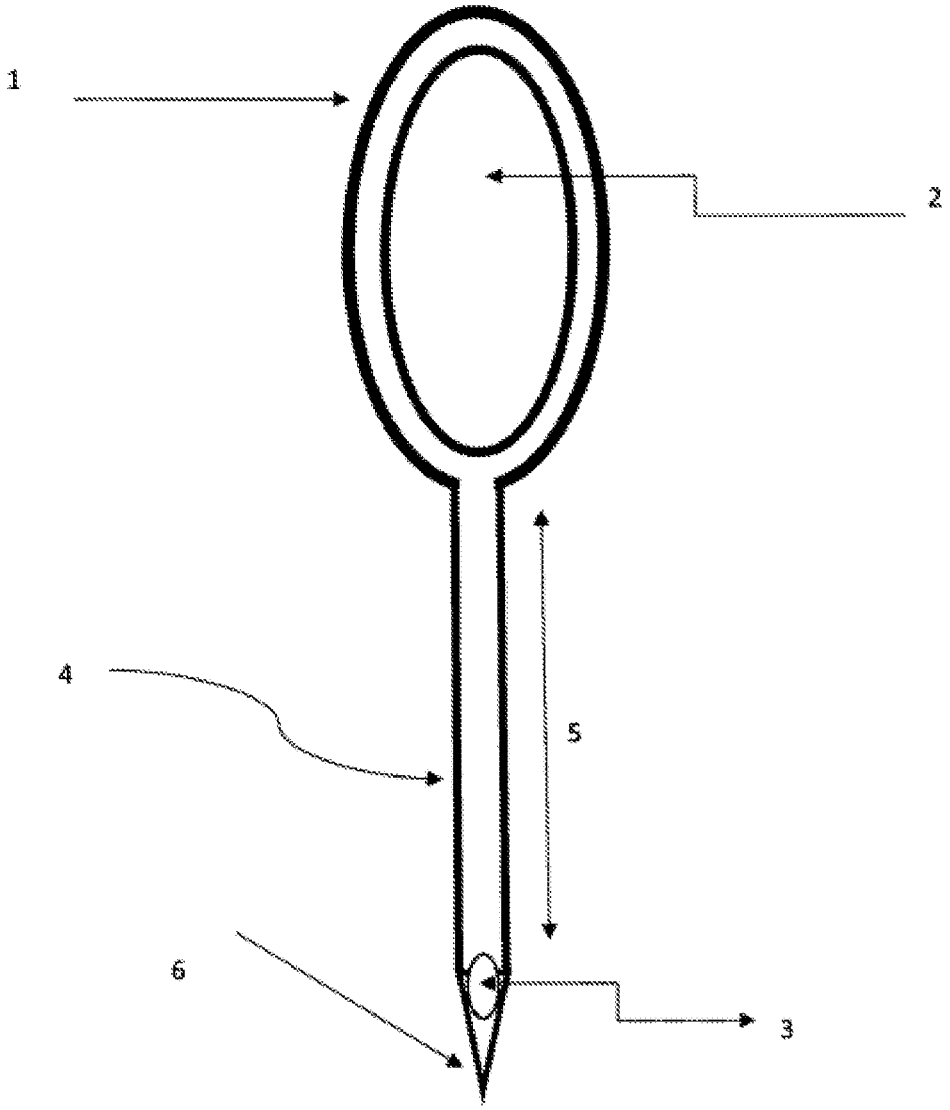
1
2
4
5
6
3

TWO WAY PLASTIC NEEDLE

The two way plastic needle is a new and unique invention, a simpler way to crochet and weave the hair.

The FIGURE shows the two way plastic needle used in the inventive method.

The two way needle 5 is designed to use both ends of the needle, the large eye 2 of the needle is to add large amount of hair through the large eye 2. The small eye 3 of the needle end 4 is to thread the needle 5 to sew the weft hair onto the braid.

Crochet and Weaving Hair

Step 1: Start with a cornrowed base—be sure that the rows have braiding hair added.

Step 2: Fold up the tails of the braids and secure them by sewing them to the base braids.

Crocheting Hair

Step 1: Fold the crochet hair and pull through the large eye 2 of the needle 5.

Step 2: Slide the needle 5 underneath the cornrow, leaving a loop of crochet hair exposed.

Step 3: Tie a knot in the loop.

Latch Hook (Crochet Hair)

Step 1: Start with a cornrowed base—be sure that the rows have braiding hair added.

Step 2: Fold up the tails of the braids and secure them by sewing them to the base braids with the needle 5.

Step 3: Hold a piece of latch hook hair by the center (you should have two equal legs).

Step 4: Slide a latch hook tool underneath a cornrow.

Step 5: Grab the center of the latch hook hair and pull it underneath the cornrow leaving just a loop exposed.

Step 6: Take the two legs and pull them through the loop.

Step 7: Cinch the hair into place.

Step 8: Continue until the cornrows are filled.

The two way needle has less steps, it is fast and convenient to handle. It is easy to clean with alcohol or hydrogen peroxide.

I claim:

1. A method of crocheting hair comprising the steps of:

providing a two way plastic needle, the two way plastic needle comprising a large eye on a first end and a small eye on a second end opposite the first end;

providing a cornrowed base of hair which includes a plurality of cornrows;

threading the small eye of the two way plastic needle;

folding up tails of cornrowed braids and securing them to the cornrows by sewing with the threaded two way plastic needle;

folding crochet hair and pulling it through the large eye of the needle;

sliding the needle underneath one of the plurality of cornrows so that a loop of crochet hair extends from the cornrow;

tying a knot in the crochet hair so that it is secured to the cornrow;

repeating the folding and sliding steps until the cornrows are filled with the crochet hair.

* * * * *